US007324054B2

(12) United States Patent
Ozkar

(10) Patent No.: US 7,324,054 B2
(45) Date of Patent: Jan. 29, 2008

(54) MULTI-BAND PIFA

(75) Inventor: Mete Ozkar, Raleigh, NC (US)

(73) Assignee: Sony Ericsson Mobile Communications AB (SE)

( * ) Notice: Subject to any disclaimer, the term of this patent is extended or adjusted under 35 U.S.C. 154(b) by 77 days.

(21) Appl. No.: 11/238,430

(22) Filed: Sep. 29, 2005

(65) Prior Publication Data

US 2007/0069956 A1 Mar. 29, 2007

(51) Int. Cl.
*H01Q 1/24* (2006.01)

(52) U.S. Cl. ..... 343/702; 343/846

(58) Field of Classification Search ..... 343/702, 343/700 MS, 846, 860
See application file for complete search history.

(56) References Cited

U.S. PATENT DOCUMENTS

| | | | | |
|---|---|---|---|---|
| 6,198,943 | B1 | 3/2001 | Sadler et al. | |
| 6,204,819 | B1 * | 3/2001 | Hayes et al. | 343/702 |
| 6,340,952 | B1 | 1/2002 | Tsai et al. | |
| 6,535,166 | B1 | 3/2003 | All | |
| 6,662,028 | B1 | 12/2003 | Hayes et al. | |
| 6,744,409 | B2 | 6/2004 | Ellis et al. | |
| 6,768,461 | B2 | 7/2004 | Huebner et al. | |
| 6,774,853 | B2 | 8/2004 | Wong et al. | |
| 6,819,287 | B2 | 11/2004 | Sullivan et al. | |
| 6,822,610 | B2 | 11/2004 | Yeh | |
| 6,856,285 | B2 | 2/2005 | Bettin et al. | |
| 6,876,329 | B2 | 4/2005 | Milosavljevic | |
| 6,882,318 | B2 | 4/2005 | Nevermann | |
| 2004/0227678 | A1 | 11/2004 | Sievenpiper | |

FOREIGN PATENT DOCUMENTS

| | | |
|---|---|---|
| EP | 0993070 | 4/2000 |
| EP | 1248317 | 10/2002 |
| EP | 1387435 | 2/2004 |
| EP | 1406345 | 4/2004 |

OTHER PUBLICATIONS

PCT International Search Report, International Application No. PCT/US2006/017732, Mailed Aug. 31, 2006.

* cited by examiner

*Primary Examiner*—Hoang V. Nguyen
(74) *Attorney, Agent, or Firm*—Coats & Bennett, P.L.L.C.

(57) ABSTRACT

The method and apparatus described herein improves the impedance matching of a multi-band antenna. In particular, the multi-band antenna comprises a radiating element vertically displaced from an antenna ground plane by feed and ground elements, and a parasitic element interposed between the feed and ground elements. When the multi-band antenna operates in the first frequency band, a selection circuit connects the parasitic element to the ground plane to capacitively couple the ground element to the feed element. However, when the multi-band antenna operates in the second frequency band, the selection circuit disables the capacitive coupling. By applying the capacitive coupling only when the multi-band antenna operates in the first frequency band, the present invention improves the performance of the antenna in the first frequency band without adversely affecting the performance of the antenna in the second frequency band.

23 Claims, 6 Drawing Sheets

MULTI-BAND PIFA

BACKGROUND

This invention relates generally to wireless communication antennas, and more particularly to multi-band antennas for wireless communication devices.

Wireless communication devices typically use multi-band antennas to transmit and receive wireless signals in multiple wireless communication frequency bands, such as Advanced Mobile Phone System (AMPS), Personal Communication Service (PCS), Personal Digital Cellular (PDC), Global System for Mobile communications (GSM), Code Division Multiple Access (CDMA), etc. Because of its compact size and multi-band performance, a planar inverted F-antenna (PIFA) represents a common multi-band antenna for wireless communication devices. PIFAs typically comprise a radiating element spaced from an antenna ground plane. Because the spacing between the radiating element and the ground plane impacts the impedance matching associated with the multi-band antenna, a PIFA typically includes additional impedance matching circuitry that optimizes the impedance matching for the desired frequency range(s) of the antenna. However, due to the wide range of frequencies covered by a multi-band PIFA, the impedance matching is only truly optimal for some of the frequency bands. As such, the antenna does not have optimal impedance matching for at least one other frequency band.

Parasitic elements that modify the impedance matching to improve antenna performance are known. However, while the parasitic element may improve antenna performance in one of the wireless communication frequency bands, the parasitic element typically adversely impacts the performance of the antenna in the other wireless communication frequency band(s).

SUMMARY

A multi-band antenna according to the present invention comprises a radiating element vertically displaced from an antenna ground plane by an antenna feed element and an antenna ground element. In addition, the multi-band antenna comprises a parasitic element operatively connected to the radiating element and interposed between the feed element and the ground element. When the multi-band antenna operates in a first frequency band, a selection circuit connects the parasitic element to the ground plane to capacitively couple the feed element with the ground element. This capacitive coupling improves impedance matching of the multi-band antenna, and therefore improves the performance of the multi-band antenna in the first frequency band. When the multi-band antenna operates in the second frequency band, the selection circuit disconnects the parasitic element from the ground plane to disable the capacitive coupling. By selectively applying the capacitive coupling, the parasitic element changes the impedance matching only when the antenna operates in the first frequency band, and therefore, does not adversely impact the impedance matching when the antenna operates in the second frequency band.

According to the present invention, the selection circuit may comprise a switch to connect and disconnect the parasitic element from the ground plane based on the operating frequency of the multi-band antenna. According to another embodiment, the selection circuit may comprise a filter, where the filter has a low impedance responsive to frequencies in the first frequency band, and has a high impedance responsive to frequencies in the second frequency band.

DETAILED DESCRIPTION

Figure 1:
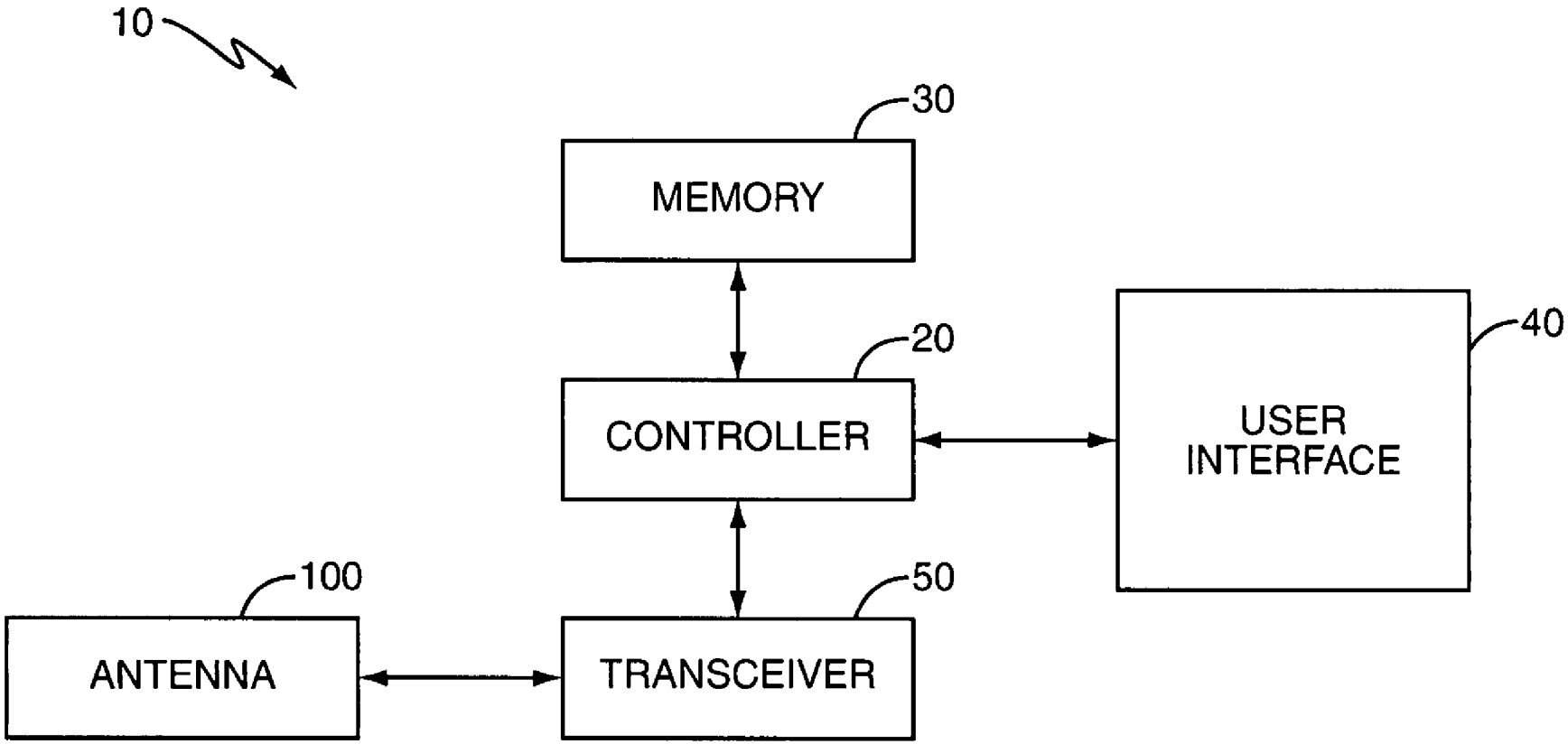
FIG. 1 illustrates a block diagram of a wireless communication device according to the present invention.

FIG. 1 illustrates a block diagram of an exemplary wireless communication device 10. Wireless communication device 10 comprises a controller 20, a memory 30, a user interface 40, a transceiver 50, and a multi-band antenna 100. Controller 20 controls the operation of wireless communication device 10 responsive to programs stored in memory 30 and instructions provided by the user via user interface 40. Transceiver 50 interfaces the wireless communication device 10 with a wireless network using antenna 100. It will be appreciated that transceiver 50 may operate according to one or more of any known wireless communication standards, such as Code Division Multiple Access (CDMA), Time Division Multiple Access (TDMA), Global System for Mobile communications (GSM), Global Positioning System (GPS), Personal Digital Cellular (PDC), Advanced Mobile Phone System (AMPS), Personal Communication Service (PCS), Wideband CDMA (WCDMA), etc.

Multi-band antenna 100 transmits and receives signals according to one or more of the above wireless communication standards. For purposes of illustration, the following describes the antenna 100 in terms of a low frequency wireless communication band and a high frequency wireless communication band. An exemplary low frequency wireless communication band includes an AMPS frequency band (850 MHz) and/or a GSM low frequency band (900 MHz). An exemplary high frequency wireless communication band includes a GSM high frequency band (1800 MHz) and/or a PCS frequency band (1900 MHz). However, it will be appreciated that antenna 100 may be designed to cover additional or alternative wireless communication frequency bands.

Figure 2:
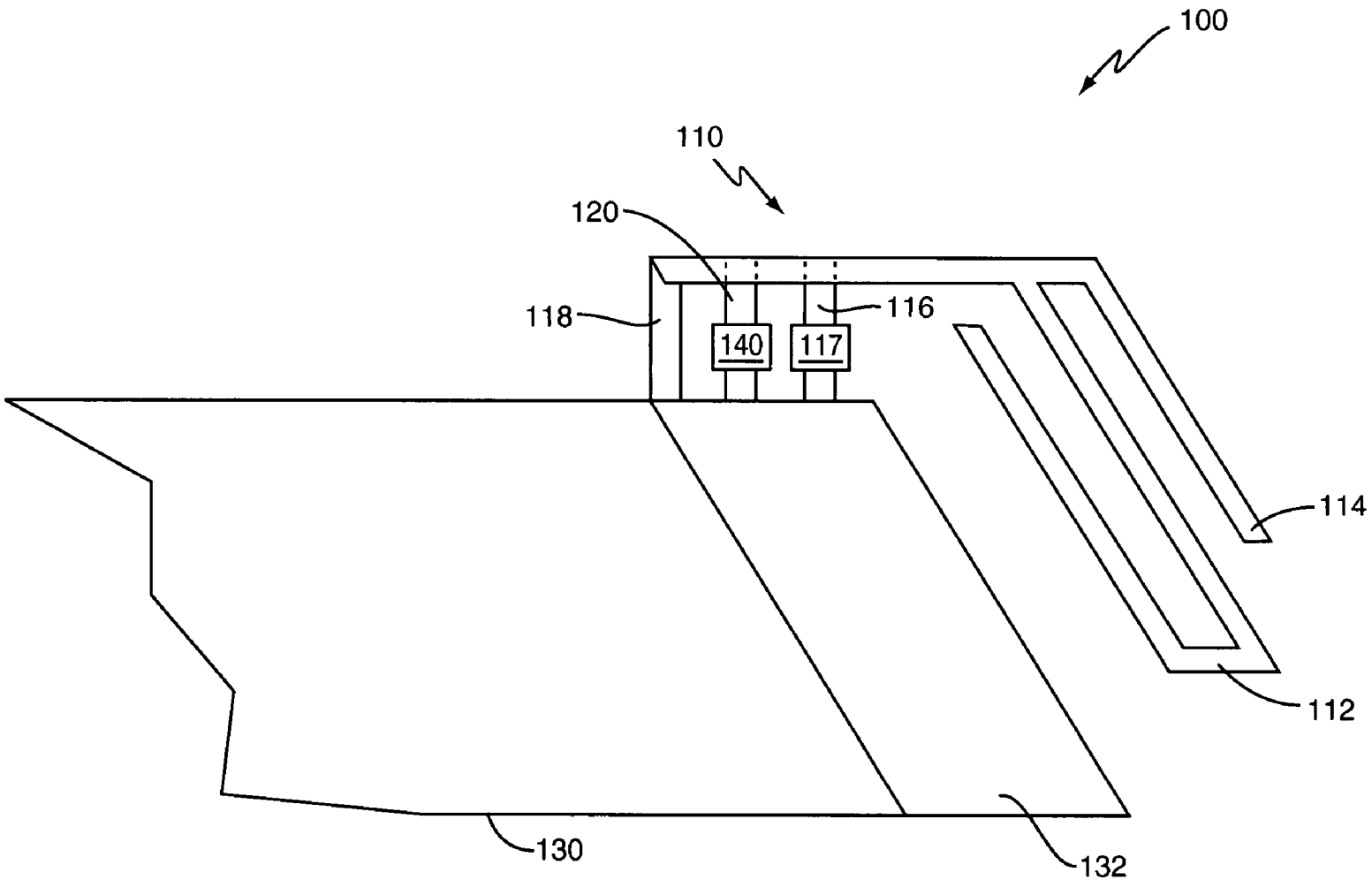
FIG. 2 illustrates an exemplary antenna according to one embodiment of the present invention.
Figure 3:
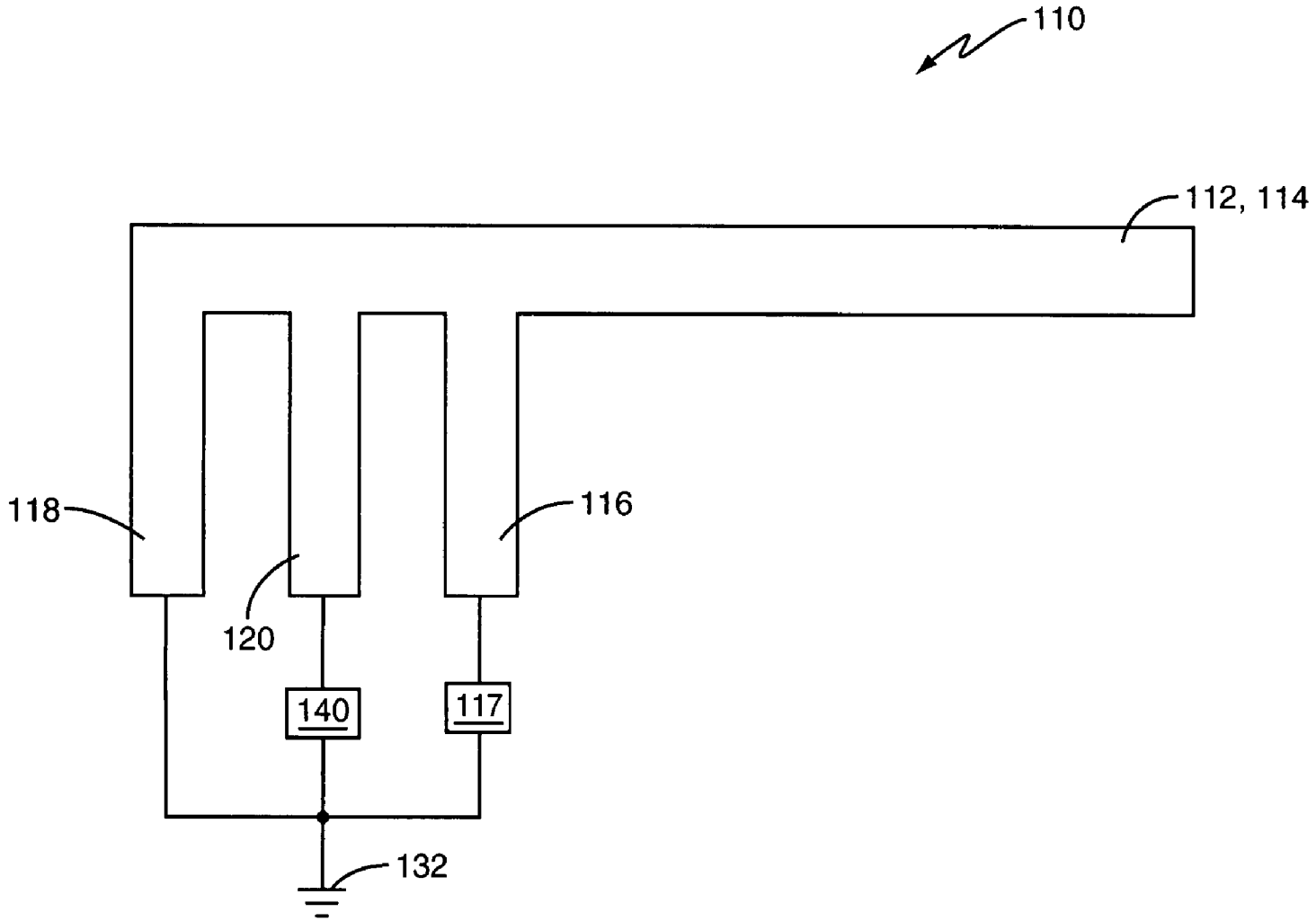
FIG. 3 illustrates a block diagram of the exemplary antenna of FIG. 2.

FIGS. 2 and 3 illustrate a multi-band antenna 100 according to one exemplary embodiment of the present invention. The exemplary multi-band antenna 100 comprises a planar inverted F-antenna (PIFA). However, the present invention also applies to other types of antennas, such as a bent monopole antenna as described in the co-pending application filed concurrently with the instant application and entitled "Multi-band Bent Monopole Antenna" (Attorney Docket No. 2002-199). This application is hereby incorporated by reference.

Antenna 100 comprises a radiating element 110 vertically spaced from a ground plane 132 of a printed circuit board (PCB) 130 by an RF feed element 116 and a ground element 118, where the feed element 116 electrically connects the radiating element 110 to an RF source 117. According to one exemplary embodiment, the feed element 116 and the ground element 118 position the radiating element 110 approximately 7 mm from PCB 130. Radiating element 110 transmits wireless communication signals provided by the RF source 117 via feed element 116 in one or more frequency bands, such as a low and a high frequency wireless communication band. Further, radiating element 110 receives wireless communication signals transmitted in the one or more frequency bands and provides the received signals to the transceiver 50 via feed element 116.

According to one embodiment of the present invention, radiating element 110 comprises a low frequency radiating element 112 and a high frequency radiating element 114. The radiating element 110 may comprise any known configuration. An exemplary radiating element 110 has a high frequency radiating element 114 with a length of 29 mm, a width of 3 mm, and is offset from the ground element 118 by approximately 17 mm, and a low frequency radiating element 112 with a length of approximately 35 mm and a width of 11 mm. As shown in FIG. 2, while the low frequency radiating element 112 at least partially overlaps a portion of the PCB 130, the high frequency radiating element 114 generally extends beyond an edge of the PCB 130.

The vertical distance between the radiating element 110 and the ground plane 132, and the horizontal distance between the RF feed element 116 and the ground element 118 impact the impedance matching of the antenna 100. Therefore, to facilitate the selective impedance matching of the present invention, multi-band antenna 100 may include a parasitic element 120 connected to the radiating element 110 and a selection circuit 140 that selectively connects the parasitic element 120 to the ground plane 132. Parasitic element 120 is interposed between the feed element 116 and the ground element 118 and is disposed generally in the same plane as the feed element 116 and the ground element 118. Because of the orientation and location of the parasitic element 120 relative to the feed and ground elements 116, 118, electromagnetic interaction between the feed element 116, the ground element 118, and the parasitic element 120 occurs when selection circuit 140 connects the parasitic element 120 to the ground plane 132. This electromagnetic interaction causes the parasitic element 120 to capacitively couple the feed element 116 to the ground element 118. This capacitive coupling effectively moves the feed point between the radiating element 110 and the ground plane 132, which changes the overall impedance matching of the antenna 100. While the parasitic element 120 may be designed to improve the impedance matching for the antenna 100 in one frequency band, i.e., the low frequency band, the design of the parasitic element 120 generally will adversely impact the impedance matching of the antenna in another frequency band, i.e., the high frequency band. By disconnecting the parasitic element 120 from the ground plane 132 when the antenna 100 operates in the high frequency band, the selection circuit 140 removes the capacitive coupling to enable normal antenna operation in the high frequency band. In other words, selection circuit 140 selectively controls the impedance matching of the antenna 100 by selectively controlling the capacitive coupling between the feed and ground elements 116 and 118.

Selection circuit 140 selectively controls the capacitive coupling by selectively controlling the connection between the parasitic element 120 and the ground plane 132. Selection circuit 140 may control the connection between the parasitic element 120 and the ground plane 132 using any means that creates a low impedance connection between the parasitic element 120 and the ground plane 132 when the antenna 100 operates in one frequency band, such as a low frequency band, and that creates a high impedance connection between the parasitic element 120 and the ground plane 132 when the antenna 100 operates in another frequency band, such as a high frequency band. In one exemplary embodiment, selection circuit 140 may comprise a switch 140 controlled by controller 20. Closing switch 140 creates a short circuit (low impedance connection) between the parasitic element 120 and the ground plane 132, while opening switch 140 creates an open circuit (high impedance connection) between the parasitic element 120 and the ground plane 132.

According to another exemplary embodiment, selection circuit 140 may comprise a filter 140. By designing the filter 140 to have a low impedance at low frequencies and a high impedance at high frequencies, the filter 140 selectively connects the parasitic element 120 to the ground plane 132 only when the antenna 100 operates in the low frequency band. According to one exemplary embodiment, the filter 140 may comprises an inductor in series with the parasitic element 120, where the inductance ranges between 5 nH and 15 nH, and preferably is approximately 10 nH.

Figure 4:
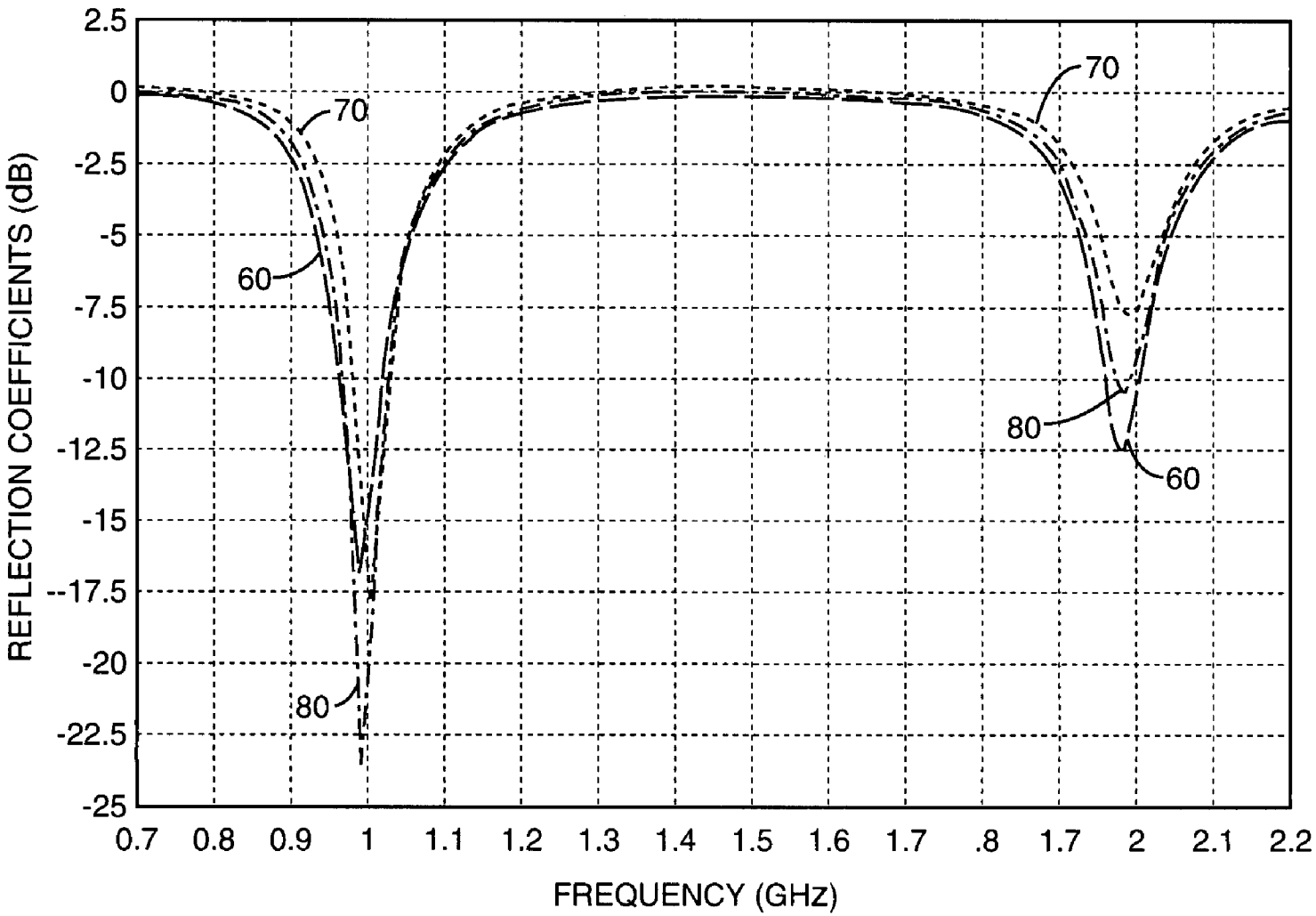
FIG. 4 illustrates an ideal reflection vs. frequency plot for the antenna of FIGS. 2 and 3.
Figure 5:
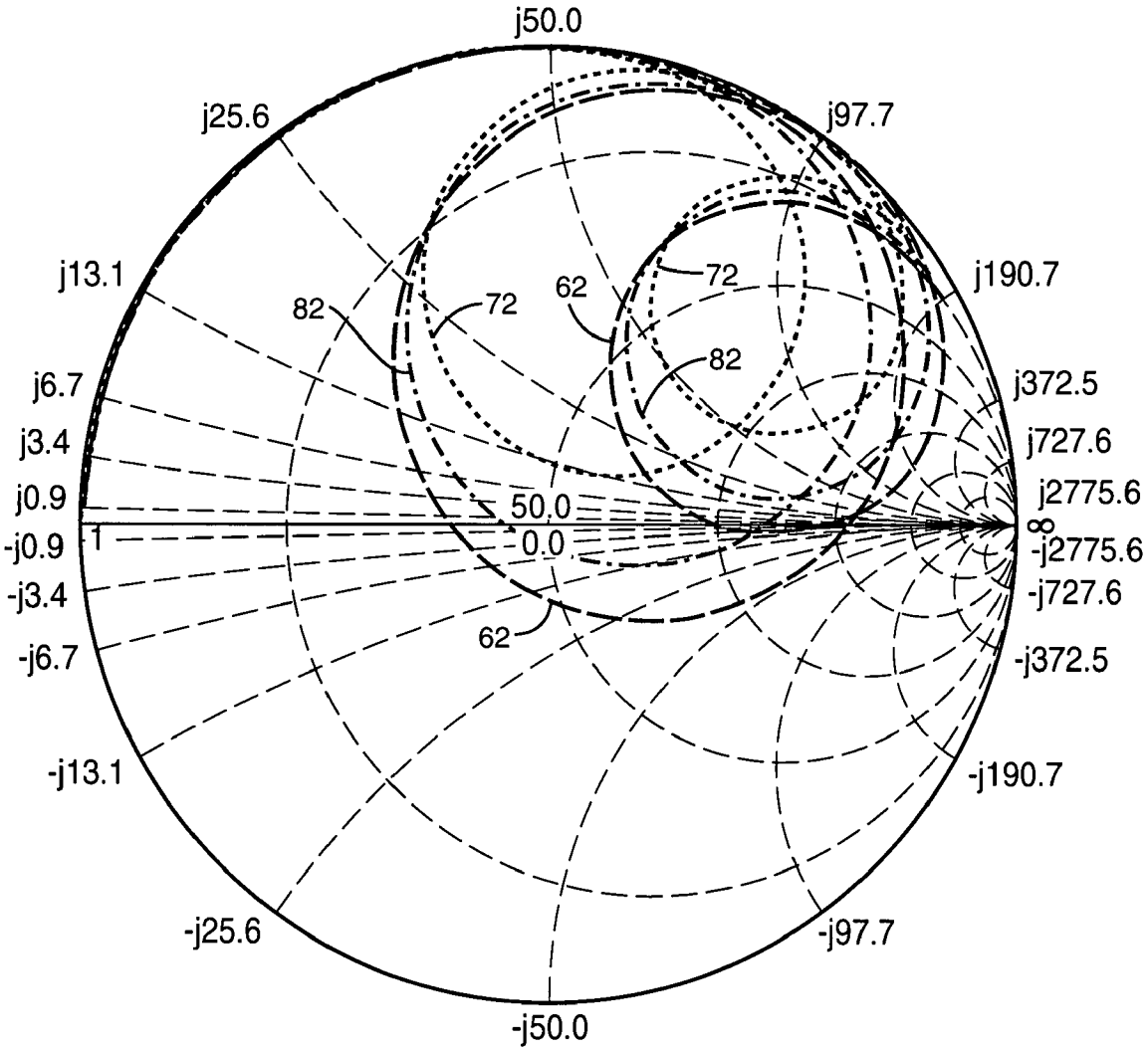
FIG. 5 illustrates an ideal Smith chart for the antenna of FIGS. 2 and 3.

FIG. 4 illustrates the reflection coefficients of the antenna 100 as a function of frequency, while FIG. 5 illustrates the reflection coefficients relative to a normalized load impedance in a Smith chart format. The illustrated reflection information was generated by an electromagnetic simulator, such as Zealand IE3D, where the selection circuit 140 for the simulation comprises a 10 nH filter 140. Because the data in FIGS. 4 and 5 represents simulated data, the plotted reflection information represents ideal reflection coefficients of the antenna and does not consider dielectric/conductor losses. Regardless, this reflection information accurately represents the effect of the capacitive coupling on the antenna's relative impedance matching.

Curve 60 in FIG. 4 illustrates the reflection coefficients of the antenna 100 with respect to frequency when the parasitic element 120 is not connected to the ground plane 132, while curve 62 in FIG. 5 illustrates these same reflection coefficients with respect to a normalized load impedance (50Ω). Curve 70 in FIG. 4 illustrates the reflection coefficients with respect to frequency when the parasitic element 120 is connected to the ground plane 132, while curve 72 illustrates these same reflection coefficients with respect to the normalized load impedance. Lastly, curve 80 in FIG. 4 illustrates the reflection coefficients with respect to frequency when selection circuit 140 connects the parasitic element 120 to the ground plane 132 for low frequencies, but disconnects the parasitic element 120 from the ground plane 132 for high frequencies. Curve 82 in FIG. 5 illustrates these same reflection coefficients with respect to the normalized load impedance.

As shown by reflection curves 70 and 72, using the parasitic element 120 to capacitively couple the feed element 116 to the ground element 118 improves the impedance matching when the antenna 100 operates in the low frequency band, but degrades the impedance matching when the antenna 100 operates in the high frequency band. However, when the parasitic element 120 is selectively connected during low frequency operation and disconnected during high frequency operation, the parasitic element 120 improves the impedance matching for the low frequency band while generally maintaining the impedance matching for the high frequency band, as shown by curves 80 and 82.

As discussed above, FIGS. 4 and 5 illustrate the performance of the antenna 100 when a 10 nH filter is used as a selection circuit 140. While the drawings do not include simulated data for the switch implementation, those skilled in the art will appreciate that when the selection circuit 140 comprises a switch 140, the resulting curve will follow curves 70 and 72 for low frequency operation, while for high frequency operation, the resulting curve will follow curves 60 and 62.

The exemplary embodiment described above improves the impedance matching of the antenna 100 for low frequencies without adversely affecting the impedance matching of the antenna 100 for high frequencies. However, it will be appreciated that the present invention is not so limited. For example, the parasitic element 120 may be designed to improve the impedance matching of the antenna 100 when the antenna 100 operates in the high frequency band. In this embodiment, selection circuit 140 would be designed and/or controlled to connect the parasitic element 120 to the ground plane 132 when the antenna 100 operates in the high frequency band, and to disconnect the parasitic element 120 from the ground plane 132 when the antenna 100 operates in the low frequency band.

Figure 6:
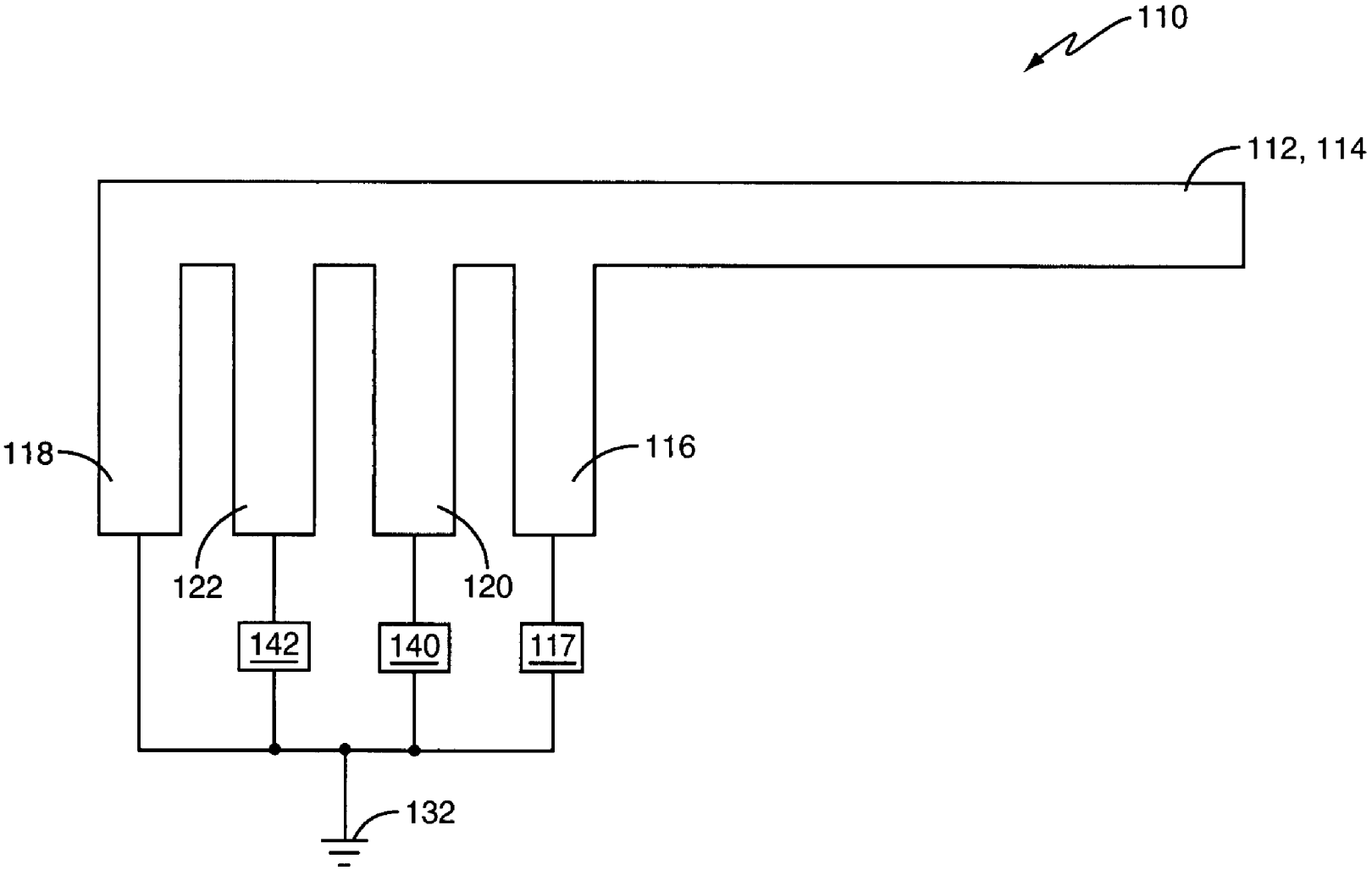
FIG. 6 illustrates a block diagram of an exemplary antenna according to another embodiment of the present invention.

Further, it will be appreciated that antenna 100 may further include a low-band parasitic element 120 and a high-band parasitic element 122, as shown in FIG. 6. According to this embodiment, selection circuit 140 connects the low-band parasitic element 120 to the ground plane 132 while selection circuit 142 disconnects the high-band parasitic element 122 from the ground plane 132 when the antenna 100 operates in the low frequency band. This improves the impedance matching of the antenna 100 during low-band operation. When the antenna 100 operates in the high frequency band, selection circuit 142 connects the high-band parasitic element 122 to the ground plane 132 while selection circuit 140 disconnects the low-band parasitic element 120 from the ground plane 132. This improves the impedance matching of the antenna 100 during high-band operation.

Further, while FIG. 6 illustrates a distinct ground element 118 for antenna 100, those skilled in the art will appreciate that the illustrated antenna 100 may exclude ground element 118. In this embodiment, the parasitic element 120, 122 connected to the ground plane 132 operates as the ground element. For example, when the antenna 100 operates in the low frequency band, selection circuit 140 connects the low-band parasitic element 120 to the ground plane 132 while selection circuit 142 disconnects the high-band parasitic element 122 from the ground plane 132, where the low-band parasitic element 120 operates as the ground element for antenna 100. When the antenna operates in the high frequency band, selection circuit 142 connects the high-band parasitic element 122 to the ground plane 132 while selection circuit 140 disconnects the low-band parasitic element 120 from the ground plane 132, where the high-band parasitic element 122 operates as the ground element for antenna 100.

The parasitic element 120 of the present invention selectively improves the impedance matching associated with at least one frequency band of a compact multi-band antenna 100 without adversely impacting the impedance matching associated with the remaining frequency bands. As such, the parasitic element 120 of the present invention improves the performance for a multi-band antenna 100 used in wireless communication devices 10.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

I claim:

1. A method for improving the performance of a multi-band antenna comprising a radiating element vertically displaced from an antenna ground plane by an antenna ground element and by an antenna feed element, the method comprising:

interposing a parasitic element connected to the radiating element between the ground element and the radiating element;

disposing a filter between the parasitic element and the ground plane, wherein the filter has a low impedance responsive to frequencies in a first frequency band and a high impedance responsive to frequencies in a second frequency band;

wherein the filter electrically connects the parasitic element to the ground plane to capacitively couple the ground element to the feed element when the multi-band antenna operates in the first frequency band; and wherein the filter disables the capacitive coupling when the multi-band antenna operates in the second frequency band.

2. The method of claim 1 wherein the one of the first and second frequency bands comprises a low frequency wireless communication band, and wherein the other of the first and second frequency bands comprises a high frequency wireless communication band.

3. The method of claim 2 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

4. The method of claim 1 wherein the multi-band antenna comprises a planar inverted F-antenna.

5. The method of claim 1 further comprising:

using a second parasitic element to capacitively couple the ground element to the feed element when the multi-band antenna operates in the second frequency band; and disabling the capacitive coupling caused by the second parasitic element when the multi-band antenna operates in the first frequency band.

6. The method of claim 5 wherein using the second parasitic element to capacitively couple the ground element to the feed element comprises using the second parasitic element as the ground element when the multi-band antenna operates in the second frequency band, and using the first parasitic element as the ground element when the multi-band antenna operates in the first frequency band.

7. A multi-band antenna for a wireless communication device comprising:

a radiating element vertically displaced from an antenna ground plane by an antenna feed element and by an antenna ground element;

a parasitic element operatively connected to the radiating element and interposed between the ground element and the feed element; and a selection circuit comprising a filter operatively connected between the parasitic element and the ground plane, wherein the filter is configured to connect the parasitic element to the ground plane to enable capacitive coupling between the feed element and the ground element when the multi-band antenna operates in a first frequency band, and configured to disconnect the parasitic element from the ground plane to disable the capacitive coupling when the multi-band antenna operates in a second frequency band.

8. The multi-band antenna of claim 7 wherein the filter has a low impedance when the multi-band antenna operates in the first frequency band, and wherein the filter has a high impedance when the multi-band antenna operates in the second frequency band.

9. The multi-band antenna of claim 7 wherein one of the first frequency and second bands comprises a low frequency wireless communication band, and wherein the other of the first and second frequency bands comprises a high frequency wireless communication band.

10. The multi-band antenna of claim 9 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

11. The multi-band antenna of claim 7 wherein the parasitic element is in the same plane as the ground element.

12. The multi-band antenna of claim 7 wherein the parasitic element is perpendicular to the radiating element.

13. The multi-band antenna of claim 7 wherein the parasitic element is parallel to the ground element.

14. The multi-band antenna of claim 7 further comprising:

a second parasitic element operatively connected to the radiating element and interposed between the feed element and the ground element; and a second selection circuit operatively connected to the second parasitic element, wherein the second selection circuit is configured to connect the second parasitic element to the ground plane to enable capacitive coupling between the feed element and the ground element when the multi-band antenna operates in the second frequency band, and configured to disconnect the second parasitic element from the ground plane to disable the capacitive coupling caused by the second parasitic element when the multi-band antenna operates in the first frequency band.

15. The multi-band antenna of claim 14 wherein the second parasitic element operates as the ground element when the multi-band antenna operates in the second frequency band, and wherein the first parasitic element operates as the ground element when the multi-band antenna operates in the first frequency band.

16. The multi-band antenna of claim 7 wherein the multi-band antenna comprises a planar inverted F-antenna.

17. A wireless communication device comprising:

a transceiver configured to transmit and receive wireless signals over a wireless network;

multi-band antenna operatively connected to the transceiver comprising:

a radiating element vertically displaced from an antenna ground plane by an antenna feed element and by an antenna ground element;

a parasitic element operatively connected to the radiating element and interposed between the ground element and the feed element; and a selection circuit comprising a filter operatively connected between the parasitic element and the ground plane, wherein the filter is configured to connect the parasitic element to the ground plane to enable capacitive coupling between the feed element and the ground element when the multi-band antenna operates in a first frequency band, and configured to disconnect the parasitic element from the ground plane to disable the capacitive coupling when the multi-band antenna operates in a second frequency band.

18. The wireless communication device of claim 17 wherein the filter has a low impedance when the multi-band antenna operates in the first frequency band, and wherein the filter has a high impedance when the multi-band antenna operates in the second frequency band.

19. The wireless communication device of claim 17 wherein one of the first and second frequency bands comprises a low frequency wireless communication band, and wherein the other of the first and second frequency bands comprises a high frequency wireless communication band.

20. The wireless communication device of claim 19 wherein the low frequency band comprises a low frequency band operational in at least one of a Global Positioning System, a Personal Digital Cellular, a Code Division Multiple Access, an Advanced Mobile Phone System, and a Global System for Mobile communications, and wherein the high frequency band comprises a high frequency band operational in at least one of a Personal Communication Service, a Code Division Multiple Access, a Global Positioning System, and a Global System for Mobile communications.

21. The wireless communication device of claim 17 wherein the multi-band antenna further comprises:

a second parasitic element operatively connected to the radiating element and interposed between the feed element and the ground element; and a second selection circuit operatively connected to the second parasitic element, wherein the second selection circuit is configured to connect the second parasitic element to the ground plane to enable capacitive coupling between the feed element and the ground element when the multi-band antenna operates in the second frequency band, and configured to disconnect the second parasitic element from the ground plane to disable the capacitive coupling caused by the second parasitic element when the multi-band antenna operates in the first frequency band.

22. The wireless communication device of claim 21 wherein the second parasitic element operates as the ground element when the multi-band antenna operates in the second frequency band, and wherein the first parasitic element operates as the ground element when the multi-band antenna operates in the first frequency band.

23. The wireless communication device of claim 17 wherein the multi-band antenna comprises a planar inverted F-antenna.

* * * * *